US011232920B2

(12) United States Patent
Goehler et al.

(10) Patent No.: US 11,232,920 B2
(45) Date of Patent: Jan. 25, 2022

(54) ARRANGEMENT AND METHOD FOR SWITCHING HIGH VOLTAGES HAVING A SWITCHING DEVICE AND PRECISELY ONE RESISTOR STACK

(71) Applicant: SIEMENS AKTIENGESELLSCHAFT, Munich (DE)

(72) Inventors: Reinhard Goehler, Berlin (DE); Lutz-Ruediger Jaenicke, Mahlow (DE); Bernd Kruska, Berlin (DE); Joerg Teichmann, Dallgow-Doeberitz (DE); Subodh Kale, Nasik (IN)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/769,854

(22) PCT Filed: Nov. 5, 2018

(86) PCT No.: PCT/EP2018/080120
§ 371 (c)(1),
(2) Date: Jun. 4, 2020

(87) PCT Pub. No.: WO2019/110214
PCT Pub. Date: Jun. 13, 2019

(65) Prior Publication Data

US 2021/0183599 A1 Jun. 17, 2021

(30) Foreign Application Priority Data

Dec. 4, 2017 (DE) ..... 102017221783.9

(51) Int. Cl.
*H01H 33/16* (2006.01)
*H01H 33/53* (2006.01)
*H01H 33/64* (2006.01)

(52) U.S. Cl.
CPC ..... *H01H 33/53* (2013.01); *H01H 33/16* (2013.01); *H01H 33/64* (2013.01)

(58) Field of Classification Search
CPC ..... H01H 33/53; H01H 33/16; H01H 33/162; H01H 33/165; H01H 33/168; H01H 9/30;
(Continued)

(56) References Cited

U.S. PATENT DOCUMENTS 2,749,411 A * 6/1956 Kelle ..... H01H 33/16 218/102
3,519,774 A * 7/1970 Rietz ..... H01H 33/165 218/91
(Continued)

FOREIGN PATENT DOCUMENTS

CH 669 863 A5 4/1989
CN 1135649 A 11/1996
(Continued)

*Primary Examiner* — William A Bolton
(74) *Attorney, Agent, or Firm* — Laurence A. Greenberg; Werner H. Stemer; Ralph E. Locher

(57) ABSTRACT

An arrangement and a method have precisely one resistor stack for switching high voltages. The arrangement contains a switching device that has two contact devices, which are arranged in an insulator. The contact devices are separated from each other by a separation path, wherein the separation path can be bridged by a movable contact piece. One contact device is in contact with the resistor stack in a common housing. The common housing is formed by a direct coating of the resistor stack and the insulator.

20 Claims, 2 Drawing Sheets

(58) Field of Classification Search
CPC ..... H02B 13/00; H02B 13/035; H01C 7/12; H01C 11/00
USPC ..... 218/146, 96, 97, 102, 105, 143; 200/144 AP
See application file for complete search history.

(56) References Cited

U.S. PATENT DOCUMENTS 4,048,457 A * 9/1977 Tragesser ..... H01H 33/75 218/105
4,069,406 A 1/1978 Meinders
4,608,470 A * 8/1986 Bischofberger ..... H01H 33/166 218/143
4,729,053 A * 3/1988 Maier ..... H01C 7/112 361/118
5,276,285 A * 1/1994 Pham ..... H01H 33/161 218/143
5,451,731 A * 9/1995 Yoshizumi ..... H01H 33/168 218/143
5,888,656 A 3/1999 Suzuki et al.
6,201,204 B1 * 3/2001 Raynaud ..... H01H 33/16 218/143
7,120,001 B2 * 10/2006 Kruska ..... H01C 7/12 361/91.2
2017/0186574 A1 6/2017 Gentsch et al.
2017/0213675 A1 7/2017 Hartmann et al.

FOREIGN PATENT DOCUMENTS

CN 201084626 Y 7/2008
CN 106098333 A 11/2016
CN 106537545 A 3/2017
CN 106716584 A 5/2017
DE 9416993 U1 12/1994
DE 102005 014206 A1 10/2006
DE 102016217496 A1 3/2018
FR 2765388 A1 12/1998
RU 2007811 C1 2/1994
RU 10932 U1 8/1999
RU 2159971 C2 11/2000
RU 2225063 C2 2/2004
RU 89762 U1 12/2009
RU 174488 U1 10/2017

* cited by examiner

ARRANGEMENT AND METHOD FOR SWITCHING HIGH VOLTAGES HAVING A SWITCHING DEVICE AND PRECISELY ONE RESISTOR STACK

BACKGROUND OF THE INVENTION

Field of the Invention

The invention relates to an arrangement and a method having precisely one resistor stack for switching high voltages. The arrangement comprises a switching device, which has two contact devices which are arranged in an insulator. The contact devices are spaced from each other by an isolating distance, wherein the isolating distance can be bridged by a movable contact piece. A contact device is in contact with the resistor stack in a common housing.

An arrangement having precisely one resistor stack for switching high voltages, in particular high voltages up to 1200 kV, is known, for example, from U.S. Pat. No. 4,069,406. In this, the arrangement comprises a high-voltage power switch as a switching device, with two contact devices. The contact devices are arranged spaced from each other with an isolating distance between the two contact devices. A movable contact piece is designed to bridge the isolating distance between the two contact devices in the switched-on state of the switching device. A contact device is in contact with the resistor stack, which limits overvoltages during the switching-on procedure.

The resistor stack comprises plate-shaped resistors, which are arranged in a common housing, clamped between two metal plates via tension rods. The first contact device, in the form of an electrode is arranged in a fixed, electrically conductive manner on one metal plate, spaced from the opposite second contact device at a spacing equal to the length of the isolating distance. The second contact device is likewise designed in the form of an electrode and arranged in a fixed manner relative to the first contact device in an insulator. Insulators refer below to mechanically stable, load-bearing housings, for example made of ceramic and/or composite materials, in particular comprising plastic. The movable contact piece is arranged on a common longitudinal axis of the two contact pieces.

In the open or switched-off state of the switching device, the movable contact piece is entirely on the side of one contact device and, during the switching-on procedure, is moved in the direction of the second contact device in order to bridge the isolating distance electrically. The movement takes place until the movable contact piece is in contact, in particular in electrical contact, with both contact devices, i.e. the first and the second contact device. During the switching-off procedure, the movable contact piece is moved in the opposite direction until the movable contact piece is arranged entirely on the side of the first contact device and the first and second contact device are electrically isolated by the isolating distance.

The two contact devices and the movable contact piece of the switching device and the resistor stack with its housing are arranged coaxially in a circular cylindrical insulator, wherein the insulator or the insulator housing is closed in a gas-tight manner at the ends via a respective flange. The resistor stack with its housing is mechanically fastened to one flange, the contact device with the movable contact piece is fastened to the other flange. The housing with the resistor stack and the two contact devices with the movable contact piece are surrounded by insulating gas with which the insulator housing is filled. $SF_6$, for example, is used as the insulating gas and/or switching gas. The mechanical stability of the arrangement for switching high voltages is ensured via the insulator, which spatially comprises both the resistors in the housing and also the two contact devices with the movable contact piece.

In this case, the insulator must be designed to be mechanically stable with sufficient wall thickness over its entire length to keep the insulating gas in the interior in particular under a pressure of more than one bar. The housing of the resistors must be designed to be mechanically stable, and/or the insulator, in particular to support the weight of the resistors with the housing and a contact device when the arrangement is fastened horizontally to the flanges. A large wall thickness of the insulator over the entire length and a housing of the resistor stack increases the weight of the arrangement, whereby one-sided mechanical fastening of the arrangement may be impossible, and increases the price and the mechanical complexity. A housing of the resistors which is arranged in the insulator at a spacing from the insulator, with a gap between the housing and the insulator filled with an insulating gas, increases the necessary quantity of insulating gas, which is in particular damaging to the environment and the climate, and increases the manufacturing and maintenance costs of the arrangement.

SUMMARY OF THE INVENTION

The object of the present invention is to specify an arrangement and a method having precisely one resistor stack for switching high voltages, which resolve the disadvantages described above. In particular, the object is to specify a simple, cost-effective, mechanically stable arrangement, which reduces the required quantity of insulating gas compared to the prior art, enables a reduction in the weight of the arrangement and saves on material.

The specified object is achieved according to the invention by an arrangement having precisely one resistor stack for switching high voltages with the features according to the independent resistor stack claim, and by a method for switching the arrangement according to the independent method claim. Advantageous configurations of the inventive arrangement having precisely one resistor stack for switching high voltages and/or the method for switching the arrangement are specified in the subclaims. In this case, the subject matters of the main claims can be combined with each other and with features of subclaims, and features of the subclaims can be combined with each other.

An inventive arrangement having precisely one resistor stack for switching high voltages comprises a switching device, having two contact devices arranged in an insulator, which are spaced from each other by an isolating distance. The isolating distance can be bridged by a movable contact piece. A contact device is in contact with the resistor stack in a common housing. The housing will be or is formed by a direct coating on the resistor stack and the insulator.

Forming the housing by a direct coating on the resistor stack and the insulator saves on an additional housing of the resistor stack, arranged between the resistor stack and the insulator with an insulating gas in the clearance. The insulator is only arranged in the region of the switching device, i.e. in the region of the two contact devices and/or the movable contact piece. Compared to the prior art, the length of the insulator is reduced and an additional housing between the insulator and the resistor stack is omitted, whereby the weight of the inventive arrangement is reduced, in particular along a longitudinal axis of the arrangement. This enables simple, cost-effective mounting of the arrangement, for example fastened by a supporting column on one side of the, in particular, horizontal arrangement. The quantity of insulating gas in the inventive arrangement is reduced in relation to arrangements known from the prior art as a result of the direct coating on the resistor stack without a gap between a housing of the resistor stack and an insulator housing. The simple construction with a reduced length of the insulator and without an additional housing of the resistor stack between the resistor stack and the insulator results in a cost-effective, simple construction, which reduces risks to the environment.

The direct coating on the resistor stack and the insulator can be made of silicone and/or comprise silicone. Silicone is weather-proof, a material with good electrical insulation and cost-effective. In this case, ribs, in particular ribs extending annularly around the lateral surface, can be formed along the outer lateral surface of the coating, which ribs enable good electrical insulation in the outer region along the longitudinal axis of the inventive arrangement, for example in damp weather.

A first and a second flange can be comprised by the inventive arrangement, between which the precisely one resistor stack and the switching device are arranged, in particular in succession, on a common longitudinal axis.

Electrical contacting of the switching device can take place via the flange and/or the inventive arrangement can be fastened, for example, to a support, in particular a column-shaped support. A support can be fastened to each flange, for example, or to a flange on only one side, wherein one-sided mechanical fastening can be enabled by the reduced weight of the inventive arrangement. A drive can be arranged in or on a support, wherein a switching movement can be transmitted from the drive to the movable contact piece of the switching device via elements of a kinematic chain.

The support with the drive can be fastened to the flange on which the contact device with the movable contact piece and, in particular, the insulator are arranged. The switching movement can thus be transmitted directly from the drive to the movable contact piece via elements of the kinematic chain arranged, for example, in the support. A support with the drive can alternatively or additionally be fastened to the opposite flange, on which the resistor stack is arranged. In this case, for example, the contact device on the resistor stack can comprise the movable contact piece and/or comprise elements of a kinematic chain, for example an insulating rod, which is designed to transmit a drive movement to the movable contact piece. In particular, with a high mass of the resistor stack, such an arrangement can ensure good mechanical stability. A support can be formed in a T-shape, with two inventive arrangements which each form an arm of the T support. It is thus possible to switch high voltages of up to 1200 kV and/or high currents of several hundred amperes.

The resistor stack can comprise at least one tension rod, which is designed to support the resistor stack mechanically. It is thus possible to dispense with a mechanically stable housing of the resistor stack, which can support a weight, and/or with an insulator which spatially comprises and/or mechanically stabilizes or supports the resistor stack. This is associated with the advantages described above. A plurality of tension rods, in particular tension rods arranged in a grid shape, for example on the outer circumference of the resistor stack, can enable good mechanical stability of the resistor stack.

The resistor stack can be tensioned between a flange and a contact device, in particular via at least one tension rod, and/or the insulator and the contact devices can be connected to a flange in a load-bearing manner, in particular one contact device can be connected to the flange in a load-bearing manner via the insulator. It is thus possible to form a mechanically stable inventive arrangement having the advantages described above, which is stabilized or supported by the tension rods on the side of the resistor stack and which is stabilized or supported by the insulator on the side of the switching device. There is no need for an insulator, for example made of ceramic, which is formed entirely between both flanges and supports the resistor stack and the switching device mechanically. Switching rods can be designed with less weight than an insulator which spatially comprises the resistor stack, thereby realizing the above-described advantages of the arrangement.

The flange on which the resistor stack is arranged can be connected to a support, in particular a column-shaped insulator, in a mechanically stable manner. The support can comprise a ceramic insulator, for example, in particular with ribs on the outer circumference, for good electrical insulation. In this case, a gear head, to which the flange is mechanically fastened, can be arranged on the support, or the flange can be mechanically fastened directly to the support. The support can be arranged upright, for example, perpendicularly on a base, with a longitudinal axis, in particular of a column-shaped support, substantially perpendicular to the plane of the base. The resistor stack can be supported by the support in a mechanically stable manner via the flange, and in particular via at least one tension rod, whereby the housing of the arrangement, which is designed in the form of the direct coating, is not subjected to a mechanical load. It is therefore possible to use materials such as silicone as the coating, which are light and weather-proof but less mechanically stable than insulators made of ceramic, for example.

The resistor stack can comprise two plates, in particular two metal plates, via which the resistors of the resistor stack are tensioned in particular by at least one tension rod. Metal plates produce a good electrical contact with the resistor stack and stable mechanical tensioning via the plates can be realized homogeneously over the full area of the plate surface. The resistor stack can be supported and tensioned in a mechanically stable manner via the at least one tension rod and the two plates, with one plate at one end of the resistor stack and a second plate at the other end of the resistor stack. The resistors are compressed or pressed via the plates, thereby establishing good electrical contact between resistors and good mechanical stability or securing of the resistors in the stack.

The resistor stack can be composed of plate-shaped resistors, in particular in a column shape, wherein the plates are arranged along a longitudinal axis, in particular two adjacent plates are in mutual form-fitting contact in each case. The resistors in plate form and the, in particular, two metal plates can have the same form, in particular all the same form. For example, the plate-shaped resistors and/or the, in particular, two metal plates can be designed to be cylindrical, for example circular cylindrical. A large bottom and top surface, with which adjacent plates are in contact in each case result in good, uniform mechanical and electrical contact.

The housing can be designed to be weather-proof, in particular with annular ribs on the outer surface. Good, long-term stable insulation over the outer surface of the housing, in particular between the two flanges, can therefore be achieved. With a weather-proof material, for example silicone, which does not have to have a mechanical load-bearing capacity, the inventive arrangement can be designed to be durable and can protect the resistor stack and the switching device against weather influences.

The arrangement can be designed to be substantially cylindrical, in particular circular cylindrical, in particular with annular ribs along the outer lateral surface. A circular cylindrical form enables good mechanical stability at little cost and is easy to manufacture.

An inventive method for switching the arrangement comprises that, during the switching-on procedure, a current path over precisely one resistor stack and a switching device between two flanges is closed by bridging an isolating distance between two contact devices with the aid of a movable contact piece, which is moved from one contact device in the direction of the other contact device until both contact devices are in electrical contact.

The mechanical load on the arrangement between the two flanges can be supported by at least one tension rod in the region of the resistor stack and by an insulator in the region of the switching device.

Electrical insulation perpendicularly to the longitudinal axis of the arrangement can be realized by a direct coating on the resistor stack and the insulator of the switching device, in particular in a weather-proof manner and/or using silicone.

A flange can be fastened to a support, in particular a supporting column, in association with the resistor stack. A flange associated with the switching device can be designed to be free-floating, in particular connected merely via electric lines.

A flange associated with the switching device can be fastened to a support, in particular a supporting column. A flange associated with the resistor stack can be designed to be free-floating, in particular connected merely via electric lines.

The advantages of the inventive method for switching the arrangement according to the independent method claim are analogous to the above-described advantages of the inventive arrangement having precisely one resistor stack for switching high voltages according to the independent resistor stack claim and vice versa.

Hereinafter, an exemplary embodiment of the invention is illustrated schematically in the single figure and described in more detail below.

DETAILED DESCRIPTION OF THE INVENTION

Figure 1:
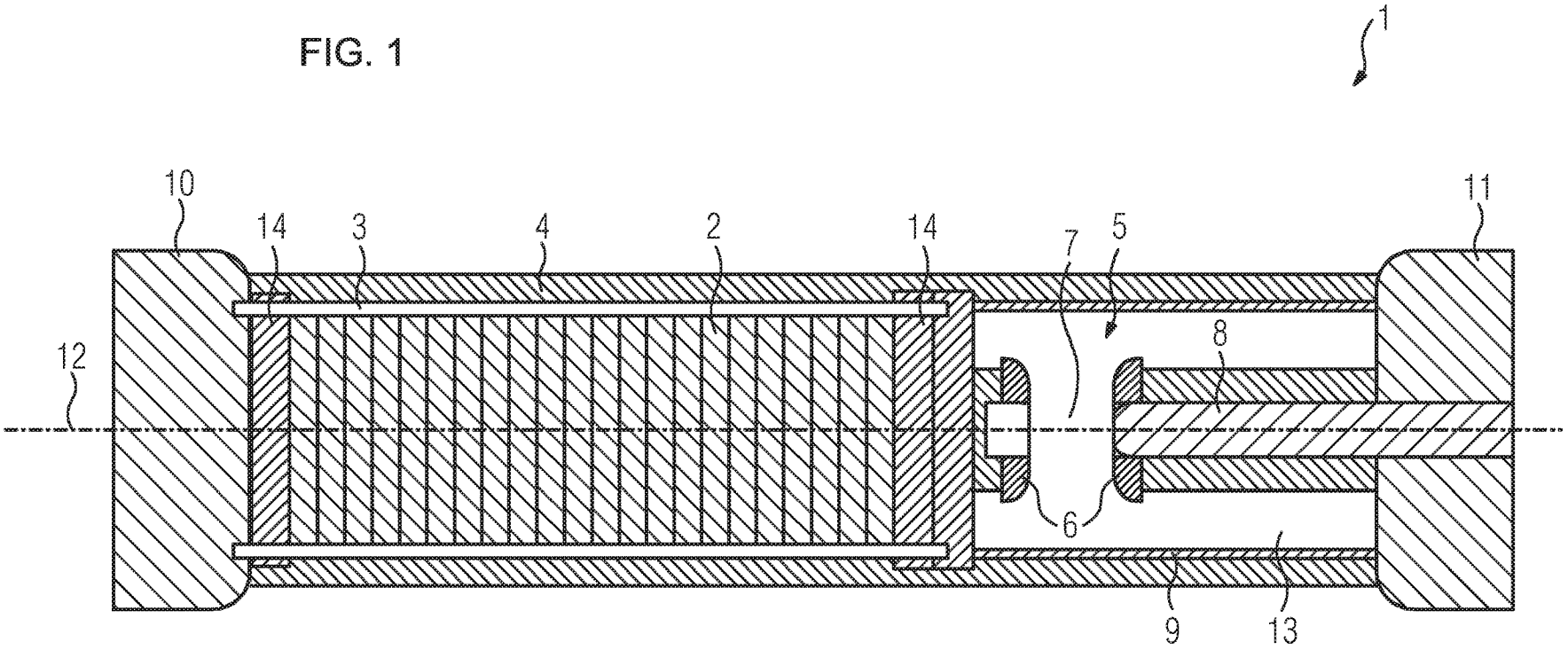
FIG. 1 is a diagrammatic, sectional view of a first embodiment of a configuration for switching high-voltages according to the invention.

FIG. 1 shows a schematic sectional view of an inventive arrangement 1 for switching high voltages, having a housing 4, which is or will be formed by directly coating a resistor stack 2 and a switching device 5.

An inventive arrangement 1 for switching high voltages is illustrated in a schematic sectional view along a longitudinal axis 12 in FIG. 1. The inventive arrangement 1 comprises precisely one resistor stack 2 and a switching device 5, arranged between two flanges 10, 11. The switching device 5 has two contact devices 6 and a movable contact piece 8, which are arranged in an insulator 9. The insulator 9 is filled, for example, with an insulating and/or switching gas, in particular $SF_6$ and/or clean air. The two contact devices 6 are immovably arranged at a fixed spacing from one another as electrodes, wherein the spacing represents an electrical isolation distance 7. In the open state of the switching device 5, a current flow between the two contact devices 6 is prevented by the isolating distance 7.

To close the switching device 5, and therefore to enable a current flow via the two contact devices 6, the movable contact piece 8 is moved by one contact device 6 in the direction of the other contact device 6 in such a way that a current path between the two contact devices 6 is closed. The contact devices 6 are designed, for example, to be circular cylindrical, in particular in the form of a hollow tube, and the movable contact piece 8 is designed, for example, to be rod- or pin-shaped, movably mounted in a contact device 6. In the open state of the switching device 5, as shown in the figure, the movable contact piece 8 is arranged entirely on one side of the switching device 5, comprised by a contact device 6.

To close the current path between the two fixed contact devices 6, i.e. for electrical closing of the switching device, the movable contact piece 8 is moved from the one contact device 6 in the direction of the opposite contact device 6 until the movable contact piece 8 is in mechanical and electrical contact with the second contact device 6, for example is inserted in the opening thereof. An electrical contact or closed current path between the two contact devices 6 is produced via the movable contact piece 8 which, in the closed state of the switching device 5, connects both contact devices 6 electrically. To open the current path between the two fixed contact devices 6, i.e. for the electrical opening of the switching device 5, the movable contact piece 8 is moved in the opposite direction until the movable contact piece 8 is back in its starting position, inserted entirely into the one contact device 6. A gap or isolating distance 7, in particular filled with insulating gas, is formed between the two contact devices 6, and the current path between the two contact devices 6 is interrupted by the isolating distance 7. The switching device 5 is in the open state.

The two contact devices 6 are arranged in a closed insulating gas space, wherein the insulating gas space is formed by the two contact devices 6, the movable contact piece 8, the insulator 9 and, in particular, a flange 11.

The two contact devices 6 and the movable contact piece 8 are arranged coaxially on the longitudinal axis 12 and are made of a material with good electrical conductivity, for example steel and/or copper. Electrical contact regions can be coated with a material with good electrical conductivity, for example with silver. A contact device 6 is, for example, designed in the form of a hollow tube, spatially comprising the movable contact piece 8 at least in part, and fastened to a flange 11. The flange 11 is disk-shaped or circular cylindrical, and the movable contact piece 8 is, in particular, movably guided by the flange 11 in a gas-tight manner.

Figure 2:
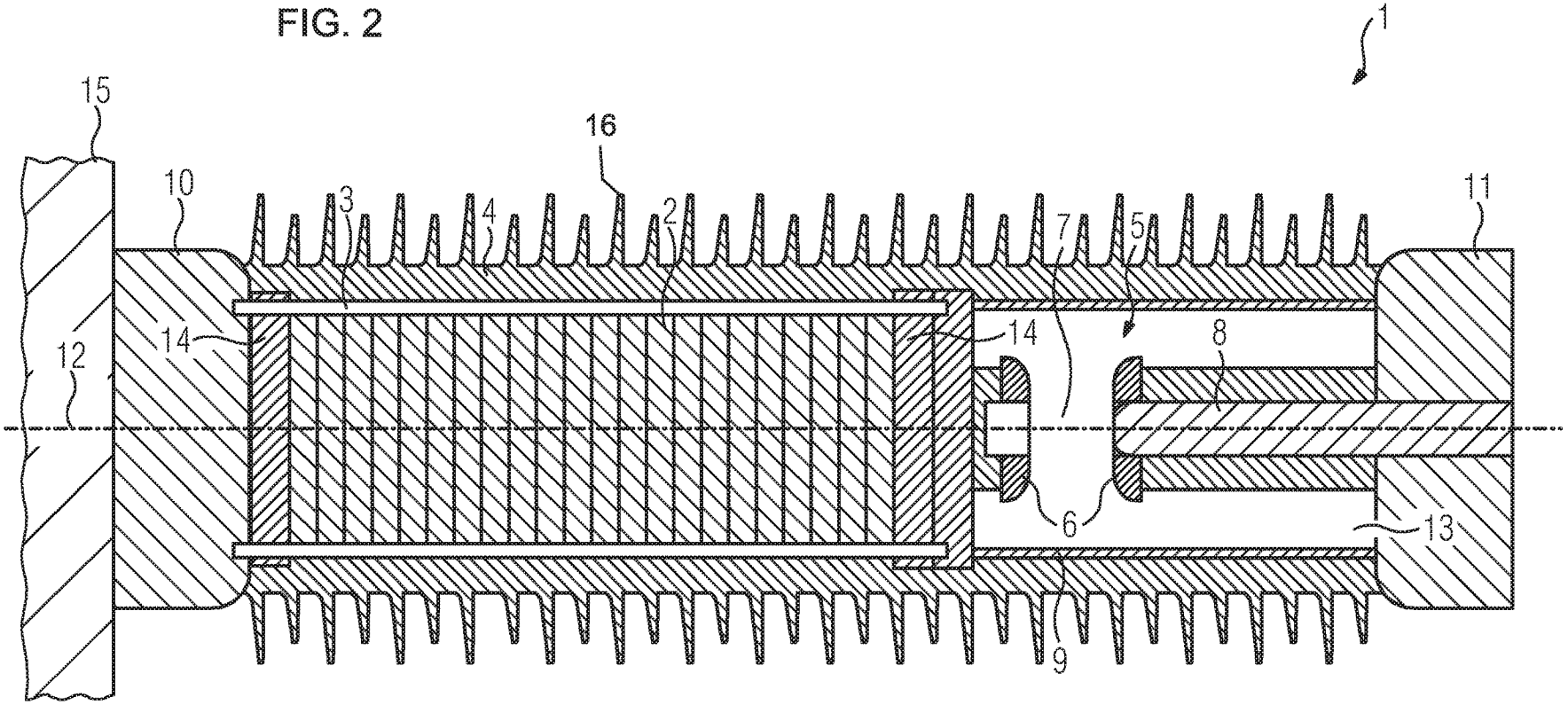
FIG. 2 is a diagrammatic, sectional view of a second embodiment of the configuration for switching high-voltages according to the invention.

Elements of a kinematic chain, for example a drive and/or switching rods and gears, are connected to the movable contact piece 8 in order to transmit movement energy to the movable contact piece 8 during the switching procedure. For the sake of simplicity, the elements of the kinematic chain are not shown in the figure. A spring-energy accumulator drive, for example, is used as the drive. The flange 11 is fastened, for example, to a gear head on a support or to the support itself. A support, which is not shown in the figure for the sake of simplicity, is designed in a column shape, for example, in particular from ceramic, and is arranged perpendicularly on a base. A support 15 can be fastened to each flange 10, 11, for example, or to a flange on only one side, wherein one-sided mechanical fastening can be enabled by the reduced weight of the inventive arrangement, see FIG. 2. The outer lateral surface, in particular of a circular cylindrical hollow support, can comprise ribs in the form of rings extending around the outer circumference for good electrical insulation along the longitudinal axis of the support. The drive can be fastened laterally to the support and elements of the kinematic chain can be movably guided in the support. At the upper end of the support, for example, an inventive arrangement 1 is arranged with the longitudinal axis 12 perpendicular to the longitudinal axis of the support, or two inventive arrangements 1, each with a flange 11, are fastened to the upper end of the support directly or via a gear head, in a T shape of the support with inventive arrangements 1.

The second contact device 6 is designed, for example, in the form of a hollow tube or is plate-shaped, with one end in the form of a hollow tube pointing in the direction of the first contact device 6 having the movable contact piece 8. The plate-shaped region of the second contact device 6 can be substantially circular cylindrical, with a diameter equal to the diameter of the resistors of the resistor stack 2. The resistors are constructed, for example, to be plate-shaped or circular cylindrical, in particular with all plates of the resistors of the resistor stack 2 having the same form. The plates are stacked on top of one another or next to one another, for example, with form fit, each with the bottom cylindrical surface of one plate in full-area contact with the top cylindrical surface of an adjacent resistor lying above or next to it. A metal plate, for example a cylindrical metal plate, is arranged, in particular, at both ends of the resistor stack 2. Alternatively, a cylindrical metal plate can be arranged, for example, at one end, and a cylindrical plate-shaped contact device 6 can be arranged, for example, at the other end.

One or more tension rods 3, for example made of an electrically insulating material, in particular plastic, which are arranged, for example, in the form of a cage around the outer circumference of the resistor stack 2 and/or along a circle or in a center bore through the resistor stack 2, hold the resistor stack 2 together. In association with, in particular, two metal plates, one at each end of the resistor stack 2, and/or a metal plate and a contact device 6, the resistors of the resistor stack 2 are pressed together and spatially secured. A contact device 6 or the switching device 5 is arranged at one end of the resistor stack 2 and a flange 10 is arranged at the other. The resistor stack can also be held together or spatially secured directly via the flange 10 and the contact device 6 in association with the tension rod(s) 3.

Connections for the inventive arrangement 1 can be provided directly on the flanges 10 and 11, or electrical connections can be guided through the flanges 10 and 11, to electrically connect the resistor stack 2 on one side and the electrically series-connected switching device 5 on the other side. Electrical consumers, current generators and/or lines for power grids, in particular, can be connected to the connections and switched via the arrangement 1. A current path between the connections is closed and/or opened via the resistor stack 2 and the switching device 5, i.e. the contact devices 6 in association with the movable contact piece 8.

According to the invention, the resistor stack 2 and the switching device 5, in particular the insulator 9 of the switching device 5, are coated directly, thereby producing a housing 4 of the arrangement 1 in association with the flanges 10, 11, for example. The coating does not have to support a mechanical load, since mechanical loads or mechanical stresses/forces are supported via the flanges 10, 11, the tension rods 3, in particular via a contact device 6, and via the insulator 9 of the switching device 5. It is therefore possible to select a coating made of silicone, for example, which is weather-proof and has a lower weight than, for example, ceramic with the same volume. The coating 4 is formed directly on the resistor stack 2 and the switching device 5, in particular the insulator 9 of the switching device 5, in particular without cavities between the resistor stack 2 and the coating 4 and/or between the insulator 9 and the coating 4. The volume of insulating gas, for example, can thus be reduced, with the advantages described above.

The coating 4 can be substantially cylindrical, in particular in form fit with the form of the resistor stack 2 and the form of the insulator 9 of the switching device 5. Ribs 16 can be formed on the outer circumference of the coating 4, in particular ribs 16 extending annularly, perpendicularly to the longitudinal axis 12, in order to increase the electrical insulating distance between the flanges 10, 11 over the outer surface of the arrangement 1, see FIG. 2. The insulator 9 can be made of ceramic and/or of an electrically insulating composite material, in particular comprising plastic. As a result of the coating 4, the, in particular, gas-tight insulator 9 can be designed to be thinner and mechanically stable, wherein it is possible to reduce the weight compared to insulators of the prior art.

The exemplary embodiments described above can be combined with each other and/or they can be combined with the prior art. Therefore, two inventive arrangements 1, for example, can be fastened to a support in a T-shape and/or more inventive arrangements 1 can be arranged on a support, for example, in a star shape. One, two or more supports can also be used for inventive arrangements 1, in particular one support on each side of the inventive arrangements 1. The inventive arrangements 1 can be substantially cylindrical, for example, or they can be designed to be rectangular, column-shaped, for example. Alternatively or additionally to the switching device 5 having two contact devices 6 and a movable contact piece 8 arranged in an insulating gas, at least one vacuum tube can be used. The resistors of the resistor stack 2 can be designed in the form of circular cylindrical plates and/or they can be rectangular or cuboidal, for example. The form and/or thickness of the resistors and the electrical resistance of all resistors can be the same or different, for example in an alternating form.

LIST OF REFERENCE SIGNS

1 Arrangement having resistor stack
2 Resistor stack
3 Tension rod
4 Direct coating
5 Switching device
6 Contact device, in particular electrode
7 Isolating distance
8 Movable contact piece
9 Insulator
10 First flange
11 Second flange
12 Longitudinal axis
13 Insulating gas
14 Plate, in particular metal plate

The invention claimed is:

1. A configuration comprising:

precisely one resistor stack for switching high voltages;

an insulator;

a common housing formed by a direct coating on said resistor stack and on said insulator; and a switching device having a movable contact piece and two contact devices disposed in said insulator and said contact devices are spaced from each other by an isolating distance, wherein said isolating distance being bridged by said movable contact piece, and wherein one of said contact devices being in contact with said resistor stack in said common housing.

2. The configuration according to claim 1, wherein said direct coating is made of silicone and/or contains silicone.

3. The configuration according to claim 1, further comprising flanges including a first flange and a second flange, and between said flanges said resistor stack and said switching device are disposed.

4. The configuration according to claim 3, wherein said resistor stack has at least one tension rod, formed to support said resistor stack mechanically.

5. The configuration according to claim 4, wherein:

said resistor stack is tensioned between one of said flanges and one of said contact devices; and/or said insulator and said contact devices are connected to one of said flanges in a load-bearing manner.

6. The configuration according to claim 5, further comprising a support, wherein said one flange on which said resistor stack is disposed is connected to said support in a mechanically stable manner.

7. The configuration according to claim 3, wherein said resistor stack and said switching device are disposed in succession, on a common longitudinal axis.

8. The configuration according to claim 4, wherein:

said resistor stack is tensioned between one of said flanges and one of said contact devices, via said at least one tension rod; and/or said insulator and said contact devices are connected to one of said flanges in a load-bearing manner, namely one of said contact devices is connected to said one flange in a load-bearing manner via said insulator.

9. The configuration according to claim 1, further comprising at least one tension rod; and wherein said resistor stack contains resistors and two plates, via said two plates said resistors of said resistor stack are tensioned by said at least one tension rod.

10. The configuration according to claim 1, wherein said resistor stack is composed of plate-shaped resistors having plates, wherein said plates are disposed along a longitudinal axis.

11. The configuration according to claim 10, wherein said resistor stack is composed of plate-shaped resistors having plates, formed in a column shape, wherein said plates are disposed along a longitudinal axis, wherein two adjacent ones of said plates are in mutual form-fitting contact in each case.

12. The configuration according to claim 1, wherein said common housing is configured to be weather-proof.

13. The configuration according to claim 12, wherein said common housing has an outer surface with annular ribs disposed on said outer surface.

14. The configuration according to claim 1, wherein the configuration is configured to be substantially cylindrical.

15. The configuration according to claim 14, wherein the configuration is configured circular cylindrical with annular ribs disposed along an outer lateral surface.

16. A method for switching a configuration containing precisely one resistor stack for switching high voltages, an insulator, a common housing formed by a direct coating on the resistor stack and on the insulator, and a switching device having a movable contact piece and two contact devices disposed in the insulator and the contact devices are spaced from each other by an isolating distance, wherein the isolating distance being bridged by the movable contact piece, and wherein one of the contact devices is in contact with the resistor stack in the common housing, which comprises the steps of:

during a switching-on procedure, a current path over the precisely one resistor stack and the switching device disposed between two flanges is closed by bridging the isolating distance between the two contact devices with an aid of the movable contact piece, which is moved from one contact device in a direction of another contact device until both of the contact devices are in electrical contact.

17. The method according to claim 16, which further comprises supporting a mechanical load on the configuration between the two flanges by at least one tension rod in a region of the resistor stack and by the insulator in a region of the switching device.

18. The method according to claim 16, which further comprises realizing an electrical insulation layer disposed perpendicularly to a longitudinal axis of the configuration by a direct coating on the resistor stack and the insulator of the switching device.

19. The method according to claim 16, wherein:

one of the flanges associated with the resistor stack is fastened to a support; and/or one of the flanges associated with the switching device is configured to be free-floating.

20. The method according to claim 16, which further comprises:

fastening one of the flanges associated with the switching device to a support; and/or configuring one of the flanges associated with the resistor stack to be free-floating.

* * * * *